US011944206B1

(12) United States Patent
Wu

(10) Patent No.: US 11,944,206 B1
(45) Date of Patent: Apr. 2, 2024

(54) DETACHABLE ROCKING CHAIR STRUCTURE

(71) Applicant: Wudi Industrial (Shanghai) Co., Ltd., Shanghai (CN)

(72) Inventor: Peng Wu, Shanghai (CN)

(73) Assignee: WUDI INDUSTRIAL (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 18/527,426

(22) Filed: Dec. 4, 2023

(30) Foreign Application Priority Data

Mar. 14, 2023 (CN) ..... 202320492672.3

(51) Int. Cl.
*A47C 3/029* (2006.01)
*A47C 4/02* (2006.01)

(52) U.S. Cl.
CPC ..... *A47C 3/029* (2013.01); *A47C 4/02* (2013.01); *A47C 4/022* (2013.01)

(58) Field of Classification Search
CPC ..... A47C 3/029; A47C 4/02; A47C 4/022; A47C 13/005
USPC ..... 297/271.6, 272.2, 272.4, 440.1, 440.11, 297/440.14, 440.15, 440.2, 440.21, 297/452.63, 447.4, 451.8, 452.2
See application file for complete search history.

(56) References Cited

U.S. PATENT DOCUMENTS 3,131,971 A * 5/1964 Gunn ..... A47C 5/04 297/452.2
5,738,409 A * 4/1998 Bursik ..... A47C 3/02 297/326
6,109,696 A * 8/2000 Newhouse ..... A47C 7/42 297/452.21
6,224,159 B1 * 5/2001 Perry ..... A47C 7/44 297/411.42
6,955,398 B1 * 10/2005 Reese ..... A47C 3/029 297/375
6,971,717 B1 * 12/2005 Rhodes ..... A47C 7/46 297/230.11
7,100,975 B1 * 9/2006 Zheng ..... A47C 4/286 297/32
7,252,333 B2 * 8/2007 Caldwell ..... A47C 3/029 297/239
D728,949 S * 5/2015 Fang ..... D6/348
D874,168 S * 2/2020 Weng ..... D6/348
10,874,218 B2 * 12/2020 Chen ..... A47C 3/029
D925,241 S * 7/2021 Chin ..... D6/348
2006/0001301 A1 * 1/2006 Caldwell ..... A47C 3/04 297/239
2008/0001463 A1 * 1/2008 Hsin-Chang ..... A47C 4/02 297/440.1

(Continued)

*Primary Examiner* — Robert Canfield

(74) *Attorney, Agent, or Firm* — Bayramoglu Law Offices LLC

(57) ABSTRACT

A detachable rocking chair structure is provided. The detachable rocking chair structure includes a main backrest rod, a main backrest reinforcement rod, a cushion side rod, a connecting crossbar, an elastic band, and a rocking chair cover, where the main backrest reinforcement rod includes a first end connected to the main backrest rod and a second end connected to the cushion side rod; the connecting crossbar and the elastic band are connected to the cushion side rod; and the rocking chair cover is sleeved on an upper surface of each of the main backrest rod, the cushion side rod, the connecting crossbar, and the elastic band.

10 Claims, 4 Drawing Sheets

(56) References Cited

U.S. PATENT DOCUMENTS

| | | | | |
|---|---|---|---|---|
| 2008/0217976 | A1* | 9/2008 | Habing | A47C 3/029<br>297/16.1 |
| 2018/0206642 | A1* | 7/2018 | Jones | A47C 7/68 |
| 2021/0127836 | A1* | 5/2021 | Sun | A47C 3/0255 |
| 2021/0393034 | A1* | 12/2021 | Sun | A47C 4/283 |
| 2022/0218109 | A1* | 7/2022 | Sun | A47C 4/283 |

* cited by examiner

DETACHABLE ROCKING CHAIR STRUCTURE

CROSS REFERENCE TO THE RELATED APPLICATIONS

This application is based upon and claims priority to Chinese Patent Application No. 202320492672.3, filed on Mar. 14, 2023, the entire contents of which are incorporated herein by reference.

TECHNICAL FIELD

The present disclosure relates to the field of rocking chair structures, and in particular to a detachable rocking chair structure.

BACKGROUND

With the improvement of people's living standards, people's demands for quality of life are rising. Especially in the current fast-paced lifestyle, more and more leisure and entertainment furniture is being developed and produced. As a type of leisure chair, rocking chairs are widely used in everyday life. Many families place rocking chairs in the living room or balcony to relax after stressful work. This relaxation method is very convenient. However, the existing rocking chairs occupy a large area, thereby reducing the packing quantity, increasing the storage space, and increasing transportation costs. In addition, in daily use, the rocking chair cover is not easy to disassemble for cleaning. Therefore, improvements need to be made to the existing rocking chair.

SUMMARY

In view of the defects in the prior art, an objective of the present disclosure is to provide a detachable rocking chair structure.

The detachable rocking chair structure according to the present disclosure includes a main backrest rod, a main backrest reinforcement rod, a cushion side rod, a connecting crossbar, an elastic band, and a rocking chair cover, where the main backrest reinforcement rod includes a first end connected to the main backrest rod and a second end connected to the cushion side rod; the connecting crossbar and the elastic band are connected to the cushion side rod; and the rocking chair cover is sleeved on an upper surface of each of the main backrest rod, the cushion side rod, the connecting crossbar, and the elastic band.

In some embodiments, the cushion side rod includes a U-shaped rod and a reinforcement rib; the reinforcement rib is provided on the U-shaped rod; and the connecting crossbar is connected to the U-shaped rod and the reinforcement rib.

In some embodiments, the U-shaped rod includes a first arc-shaped rod, a second arc-shaped rod, and a connecting rod; and the first arc-shaped rod and the second arc-shaped rod each include a first end serving as a fixing end and a second end connected to the connecting rod.

In some embodiments, the fixing end of the first arc-shaped rod is nested inside the main backrest rod; and the fixing end of the second arc-shaped rod is nested inside the main backrest reinforcement rod.

In some embodiments, an outer diameter of the fixing end is smaller than an inner diameter of each of the main backrest rod and the main backrest reinforcement rod.

In some embodiments, the connecting crossbar includes a first connecting crossbar, a second connecting crossbar, and a third connecting crossbar; the first connecting crossbar is connected to the reinforcement rib; the second connecting crossbar is connected to the second arc-shaped rod; and the third connecting crossbar is connected to the connecting rod.

In some embodiments, the elastic band is connected to the first arc-shaped rod.

In some embodiments, two ends of the elastic band are respectively provided with hooks; and the hooks are respectively connected to the first arc-shaped rod.

In some embodiments, a bottom of the second arc-shaped rod is provided with a protective rubber strip.

In some embodiments, the first end of the main backrest reinforcement rod is provided with an inclined surface; and the inclined surface is adaptively connected to the main backrest rod.

Compared with the prior art, the present disclosure has the following beneficial effects:

The present disclosure reduces the volume of the product through a detachable frame and a detachable rocking chair cover, thereby increasing the packing quantity, reducing the storage space, and saving transportation costs.

BRIEF DESCRIPTION OF THE DRAWINGS

Other features, objectives, and advantages of the present disclosure will become more apparent by reading the detailed description of non-limiting embodiments with reference to the following drawings.

REFERENCE NUMERALS

1. main backrest rod; 2. main backrest reinforcement rod; 3. cushion side rod; 31. U-shaped rod; 32. reinforcement rib; 311. first arc-shaped rod; 312. second arc-shaped rod; 313. connecting rod; 314. fixing end; 4. connecting crossbar; 41. first connecting crossbar; 42. second connecting crossbar; 43. third connecting crossbar; 5. elastic band; 6. rocking chair cover; and 7. protective rubber strip.

DETAILED DESCRIPTION OF THE EMBODIMENTS

The following describes the present disclosure in detail in conjunction with particular embodiments. The following embodiments will be conducive to further understanding of the present disclosure by a person of ordinary skill in the art, but does not limit the present disclosure in any form. It should be noted that several variations and improvements can also be made by a person of ordinary skill in the art without departing from the conception of the present disclosure. These variations and improvements shall fall within the protection scope of the present disclosure.

Embodiment

Figure 1:
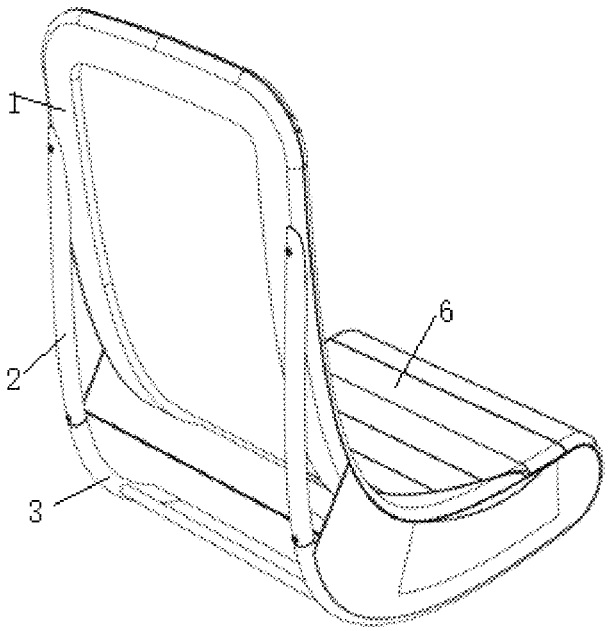
FIG. 1 is a structural diagram of a detachable rocking chair structure according to the present disclosure.
Figure 2:
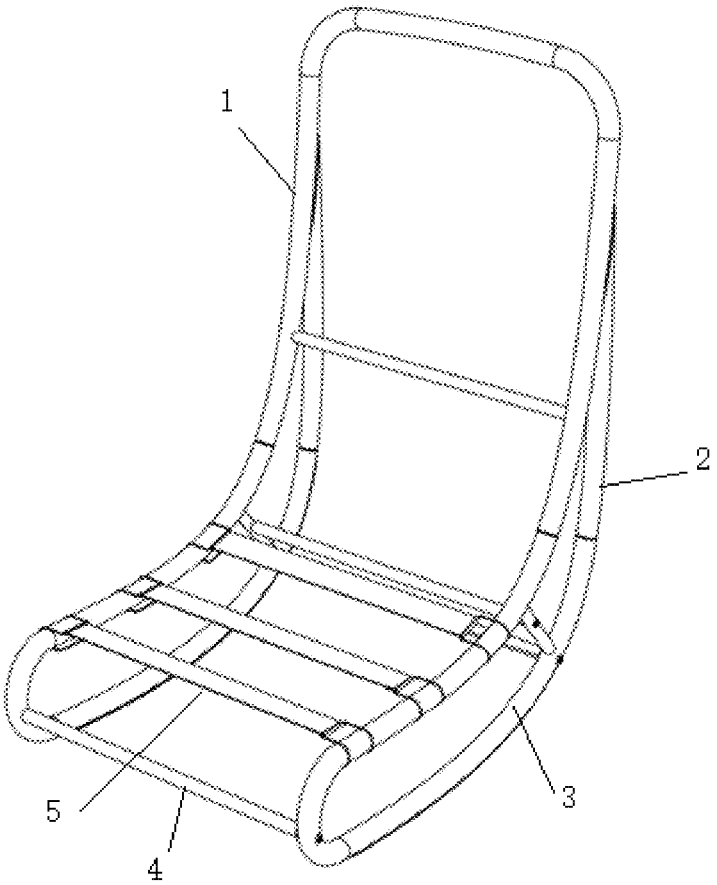
FIG. 2 is a structural diagram of a frame of the detachable rocking chair structure according to the present disclosure.
Figure 3:
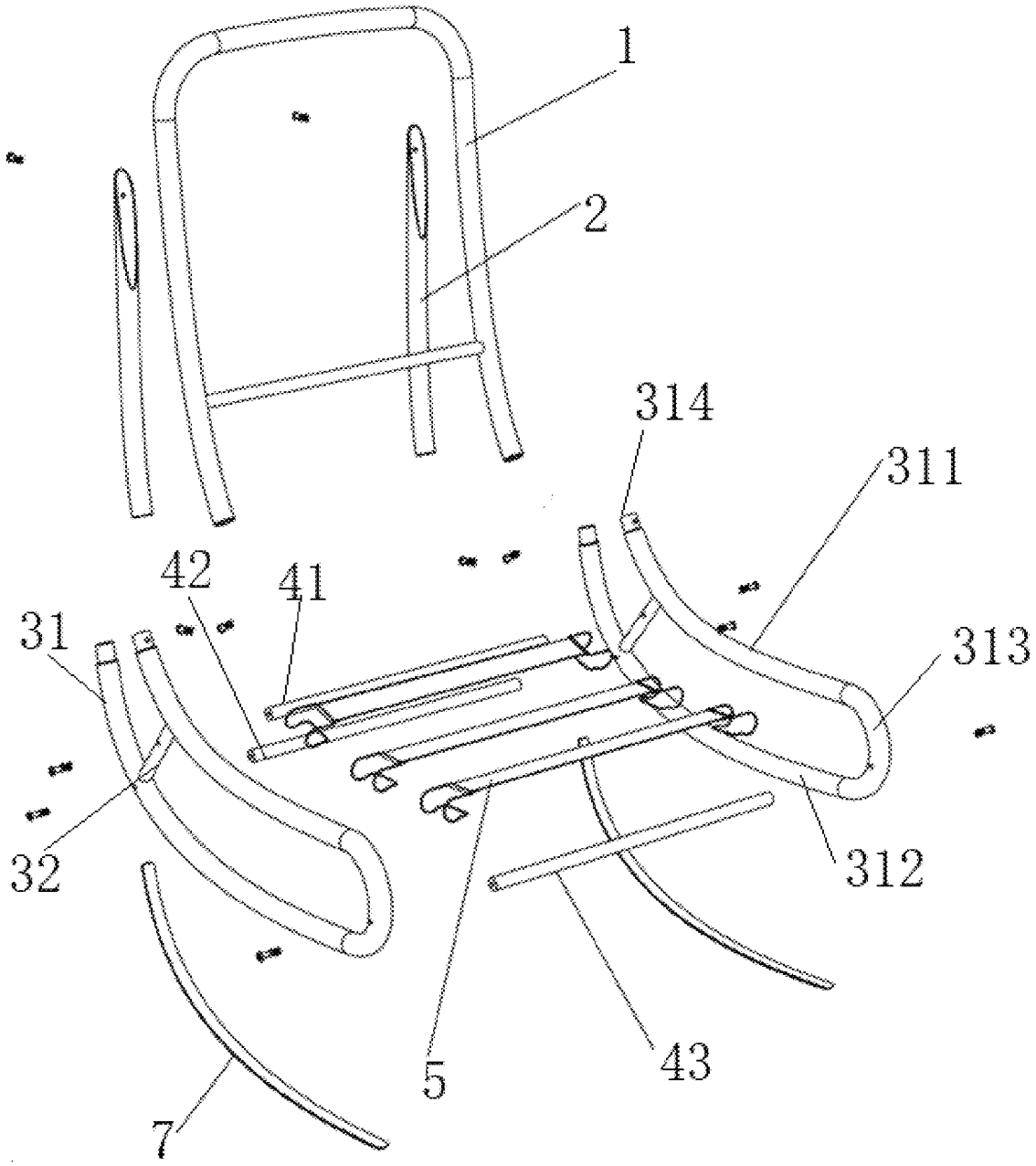
FIG. 3 is an exploded view of the frame of the detachable rocking chair structure according to the present disclosure.
Figure 4:
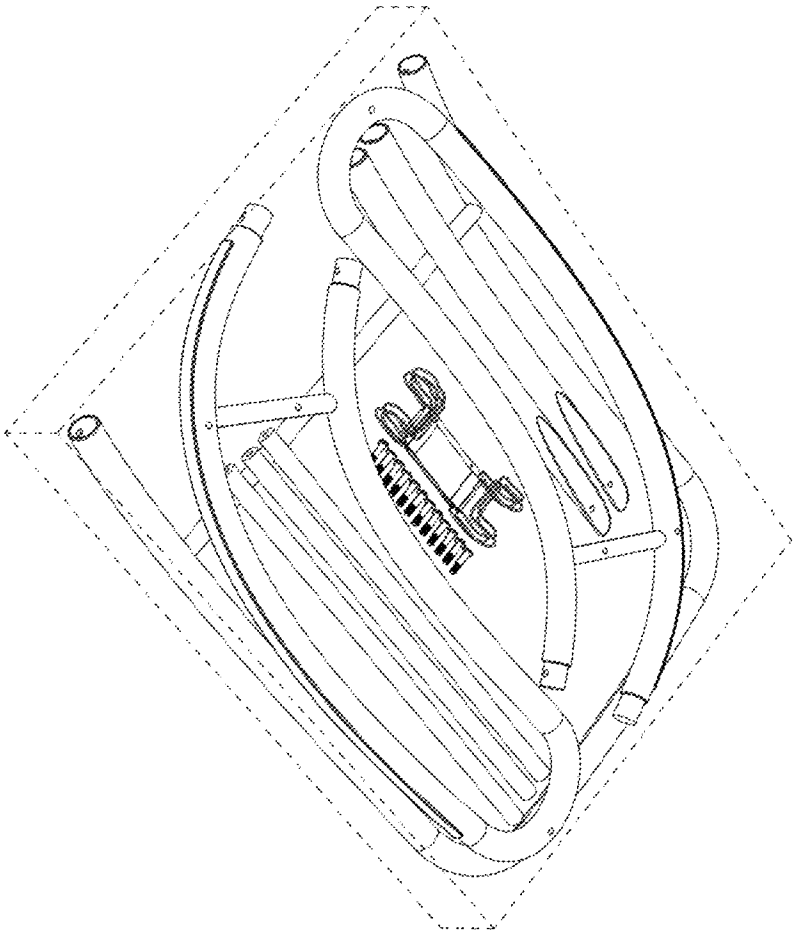
FIG. 4 is a structural diagram of the detachable rocking chair structure in a folded state according to the present disclosure.

The present disclosure provides a detachable rocking chair structure. As shown in FIGS. 1 to 4, the detachable rocking chair structure includes main backrest rod 1, main backrest reinforcement rod 2, cushion side rod 3, connecting crossbar 4, elastic band 5, and rocking chair cover 6. First end of the main backrest reinforcement rod 2 is provided with an inclined surface. The inclined surface is provided with a fixing hole. A fixing bolt passes through the fixing hole to adaptively fix the inclined surface to the main backrest rod 1. Second end of the main backrest reinforcement rod 2 is connected to the cushion side rod 3. The connecting crossbar 4 and the elastic band 5 are connected to the cushion side rod 3. The rocking chair cover 6 is sleeved on an upper surface of each of the main backrest rod 1, the cushion side rod 3, the connecting crossbar 4, and the elastic band 5.

The cushion side rod 3 includes U-shaped rod 31 and reinforcement rib 32. The reinforcement rib 32 is provided on the U-shaped rod 31. The connecting crossbar 4 is connected to the U-shaped rod 31 and the reinforcement rib 32. The U-shaped rod 31 includes first arc-shaped rod 311, second arc-shaped rod 312, and connecting rod 313. The first arc-shaped rod 311 and the second arc-shaped rod 312 each include a first end serving as fixing end 314 and a second end connected to the connecting rod 313. An outer diameter of the fixing end 314 is smaller than an inner diameter of each of the main backrest rod 1 and the main backrest reinforcement rod 2. The fixing end 314 is provided with a fixing hole. A fixing bolt passes through the fixing hole of the first arc-shaped rod 311 to nest the fixing end 314 of the first arc-shaped rod inside the main backrest rod 1. A fixing bolt passes through the fixing hole of the second arc-shaped rod 312 to nest the fixing end 314 of the second arc-shaped rod inside the main backrest reinforcement rod 2. Two ends of the elastic band 5 are respectively provided with hooks. The hooks are respectively connected to the first arc-shaped rod 311.

The connecting crossbar 4 includes first connecting crossbar 41, second connecting crossbar 42, and third connecting crossbar 43. The first connecting crossbar 41 is provided on the reinforcement rib 32 through a fixing bolt, and the second connecting crossbar 42 is provided on the second arc-shaped rod 312 through a fixing bolt. A bottom of the second arc-shaped rod 312 is provided with protective rubber strip 7. The third connecting crossbar 43 is provided on the connecting rod 313 through a fixing bolt.

In the description of the present application, it needs to be understood the orientation or positional relationships indicated by terms, such as "up", "down", "front", "rear", "left", "right", "vertical", "horizontal", "top", "bottom", "inside", and "outside", are based on the orientation or positional relationship shown in the drawings, are merely for facilitating the description of the present application and simplifying the description, rather than indicating or implying that an apparatus or element referred to must have a particular orientation or be constructed and operated in a particular orientation, and therefore shall not be interpreted as limiting the present application.

The particular embodiments of the present disclosure are described as above. It should be understood that the present disclosure is not limited to the above specific embodiments. Those skilled in the art can make various changes or modifications within the scope of the claims, which does not affect the essence of the present disclosure. The embodiments of the present disclosure and features in the embodiments may be arbitrarily combined with each other in a non-conflicting situation.

What is claimed is:

1. A detachable rocking chair structure, comprising a main backrest rod, a main backrest reinforcement rod, a cushion side rod, a connecting crossbar, an elastic band, and a rocking chair cover, wherein the main backrest reinforcement rod comprises a first end connected to the main backrest rod and a second end connected to the cushion side rod; the connecting crossbar and the elastic band are connected to the cushion side rod; and the rocking chair cover is sleeved on an upper surface of each of the main backrest rod, the cushion side rod, the connecting crossbar, and the elastic band.

2. The detachable rocking chair structure according to claim 1, wherein the cushion side rod comprises a U-shaped rod and a reinforcement rib; the reinforcement rib is provided on the U-shaped rod; and the connecting crossbar is connected to the U-shaped rod and the reinforcement rib.

3. The detachable rocking chair structure according to claim 2, wherein the U-shaped rod comprises a first arc-shaped rod, a second arc-shaped rod, and a connecting rod; and the first arc-shaped rod and the second arc-shaped rod each comprise a first end serving as a fixing end and a second end connected to the connecting rod.

4. The detachable rocking chair structure according to claim 3, wherein the fixing end of the first arc-shaped rod is nested inside the main backrest rod; and the fixing end of the second arc-shaped rod is nested inside the main backrest reinforcement rod.

5. The detachable rocking chair structure according to claim 4, wherein an outer diameter of the fixing end is smaller than an inner diameter of each of the main backrest rod and the main backrest reinforcement rod.

6. The detachable rocking chair structure according to claim 3, wherein the connecting crossbar comprises a first connecting crossbar, a second connecting crossbar, and a third connecting crossbar; the first connecting crossbar is connected to the reinforcement rib; the second connecting crossbar is connected to the second arc-shaped rod; and the third connecting crossbar is connected to the connecting rod.

7. The detachable rocking chair structure according to claim 3, wherein the elastic band is connected to the first arc-shaped rod.

8. The detachable rocking chair structure according to claim 7, wherein two ends of the elastic band are respectively provided with hooks.

9. The detachable rocking chair structure according to claim 3, wherein a bottom of the second arc-shaped rod is provided with a protective rubber strip.

10. The detachable rocking chair structure according to claim 1, wherein the first end of the main backrest reinforcement rod is provided with an inclined surface; and the inclined surface is adaptively connected to the main backrest rod.

* * * * *